US007779961B2

(12) United States Patent
Matte

(10) Patent No.: US 7,779,961 B2
(45) Date of Patent: Aug. 24, 2010

(54) EXHAUST GAS DIFFUSER

(76) Inventor: François Matte, 3775, avenue des Compagnons, Québec, QC (CA) G1X 5C3

( * ) Notice: Subject to any disclaimer, the term of this patent is extended or adjusted under 35 U.S.C. 154(b) by 0 days.

(21) Appl. No.: 11/943,148

(22) Filed: Nov. 20, 2007

(65) Prior Publication Data

US 2008/0116005 A1 May 22, 2008

Related U.S. Application Data

(60) Provisional application No. 60/866,500, filed on Nov. 20, 2006.

(51) Int. Cl.

| | |
|---|---|
| ***F01N 13/08*** | (2010.01) |
| ***F01N 1/16*** | (2010.01) |
| *F01N 13/00* | (2010.01) |
| *F01N 1/00* | (2010.01) |

(52) U.S. Cl. ..... 181/227; 181/237; 60/324; 60/322

(58) Field of Classification Search ..... 181/264, 181/227, 228, 237, 236, 271, 239, 224, 231; 60/324, 317, 322

See application file for complete search history.

(56) References Cited

U.S. PATENT DOCUMENTS

| | | | | | |
|---|---|---|---|---|---|
| 1,342,464 | A | * | 6/1920 | Sawders et al. | 181/239 |
| 1,439,717 | A | * | 12/1922 | Smith | 237/31 |
| 1,856,005 | A | * | 4/1932 | Tomshow | 181/263 |
| 1,867,802 | A | * | 7/1932 | Bogert | 181/263 |
| 1,993,863 | A | * | 3/1935 | Small et al. | 181/264 |
| 2,112,534 | A | * | 3/1938 | Keen | 181/227 |
| 2,242,294 | A | | 5/1941 | Fox et al. | |
| 2,242,494 | A | | 5/1941 | Wolf | |
| 2,420,700 | A | * | 5/1947 | Curphy | 454/5 |
| 2,482,577 | A | * | 9/1949 | Dahlstrom | 454/41 |
| 2,654,437 | A | * | 10/1953 | Woods | 181/239 |
| D174,138 | S | * | 3/1955 | Russo | D12/194 |
| 2,732,913 | A | * | 1/1956 | Higgins | 96/386 |
| 2,813,474 | A | * | 11/1957 | Honerkamp et al. | 454/265 |
| 2,950,776 | A | * | 8/1960 | Stephens | 181/224 |
| 2,975,854 | A | * | 3/1961 | Bakke et al. | 181/239 |
| 3,008,694 | A | | 11/1961 | Todd | |
| 3,781,920 | A | * | 1/1974 | Browne et al. | 4/441 |
| 3,788,072 | A | * | 1/1974 | Burger | 60/324 |
| 3,788,417 | A | * | 1/1974 | Willis | 180/309 |
| 3,791,282 | A | * | 2/1974 | McElhose et al. | 454/5 |
| 3,866,580 | A | | 2/1975 | Whitehurst et al. | |
| 3,923,114 | A | | 12/1975 | Suzuki | |

(Continued)

FOREIGN PATENT DOCUMENTS

| | | |
|---|---|---|
| EP | 1770249 | 4/2007 |

(Continued)

*Primary Examiner*—Edgardo San Martin
(74) *Attorney, Agent, or Firm*—Ogilvy Renault, LLP

(57) ABSTRACT

The diffuser can be used at an end of a vehicle exhaust system. The diffuser can have a generally hollow body with an inlet for receiving exhaust gasses from a substantially vertically-extending component of the vehicle exhaust system, and a substantially flat outlet grate through which the exhaust gasses are to be released to the atmosphere, the outlet grate being configured and adapted for use in a roof of the vehicle, in an aligned position therewith, with the hollow body of the diffuser positioned inside the vehicle and below the outlet grate.

14 Claims, 5 Drawing Sheets

U.S. PATENT DOCUMENTS 3,955,950 A 5/1976 Miller, Jr.
3,989,415 A * 11/1976 Van-Hee et al. ..... 417/312
4,164,989 A * 8/1979 Lux et al. ..... 181/265
4,197,703 A 4/1980 Holmes
D254,904 S * 5/1980 Swearingen ..... D12/345
4,324,286 A 4/1982 Brett
4,450,934 A * 5/1984 Davis ..... 181/228
4,651,524 A 3/1987 Brighton
4,696,368 A * 9/1987 Hummel et al. ..... 180/309
4,821,629 A * 4/1989 Davison et al. ..... 454/5
4,864,821 A 9/1989 Hoch
4,877,106 A * 10/1989 Neville et al. ..... 181/224
4,903,484 A * 2/1990 Yates et al. ..... 60/316
4,923,487 A 5/1990 Bogart et al.
5,069,154 A 12/1991 Carter
5,170,020 A * 12/1992 Kruger et al. ..... 181/211
5,321,215 A * 6/1994 Kicinski ..... 181/211
5,390,492 A 2/1995 Levendis
D357,665 S * 4/1995 Creyts ..... D12/194
5,438,842 A 8/1995 Watkins et al.
5,497,620 A 3/1996 Stobbe
5,603,214 A * 2/1997 Abels et al. ..... 60/273
5,625,172 A * 4/1997 Blichmann et al. ..... 181/204
5,656,048 A 8/1997 Smith et al.
5,725,618 A 3/1998 Shimoda et al.
D394,236 S * 5/1998 Verlengiere ..... D12/194
5,808,245 A * 9/1998 Wiese et al. ..... 181/255
5,829,248 A 11/1998 Clifton
5,853,438 A 12/1998 Igarashi
5,866,859 A * 2/1999 Karlsson et al. ..... 181/230
5,971,097 A 10/1999 Etheve
6,240,957 B1 * 6/2001 Hattori ..... 137/527.6
D456,444 S * 11/2002 Witham ..... D12/112
6,527,006 B2 * 3/2003 Jackson ..... 137/527.6
6,712,869 B2 3/2004 Cheng et al.
6,732,511 B2 * 5/2004 Unbehaun et al. ..... 60/324
6,802,387 B1 * 10/2004 Kreger et al. ..... 181/228
6,868,670 B1 3/2005 Schellin
7,114,330 B1 10/2006 Schellin
2001/0018826 A1 9/2001 Rusch
2004/0139734 A1 7/2004 Schmeichel et al.
2004/0219077 A1 11/2004 Voss et al.
2005/0132696 A1 6/2005 Tumati et al.
2005/0284142 A1 12/2005 Patil et al.
2006/0059899 A1 3/2006 Bailey
2006/0068159 A1 3/2006 Komori et al.
2006/0096280 A1 5/2006 Zhan et al.
2006/0194018 A1 8/2006 Ohno et al.
2006/0260296 A1 11/2006 Theis
2007/0000239 A1 1/2007 Liu et al.
2007/0029132 A1 2/2007 Feight et al.
2007/0039316 A1 2/2007 Bosanec et al.
2007/0113547 A1 5/2007 Thaler
2007/0144158 A1 6/2007 Girard et al.
2007/0163247 A1 7/2007 Ryan et al.
2007/0163249 A1 7/2007 Clerc et al.
2007/0169452 A1 7/2007 Grimm et al.

FOREIGN PATENT DOCUMENTS

JP 52044325 A * 4/1977

* cited by examiner

EXHAUST GAS DIFFUSER

CROSS-REFERENCE TO RELATED APPLICATIONS

This application claims priority of U.S. Provisional Patent Application No. 60/866,500, filed Nov. 20, 2006, the contents of which are hereby incorporated.

BACKGROUND

It is desired in many instances to control the temperature at which exhaust gasses are exhausted into the atmosphere, and to maintain the temperature of exhaust gasses below certain thresholds at given distances from the vehicle, to alleviate the impact that exhaust heat can have on the vehicle's immediate environment.

Further, the importance of exhaust gas treatment units in exhaust systems of diesel engine vehicles has considerably increased during past years, much with the trend to obtain "cleaner" emissions or "greener" vehicles. Diesel particle filters, or DPFs, which can reduce particulate emissions, and selective catalytic reduction units, or SCRs, which can reduce NOx emissions, are two examples of exhaust gas treatment units which can be used with diesel engine vehicles.

There is a drawback of some exhaust gas treatment units which is related to the fact that they can emit a relatively large amount of heat into the exhaust gasses. The consideration of their use imposes an additional burden with respect to heat management. Diesel particle filters (DPFs), for instance, accumulate particulate matter or soot. To get rid of the accumulated matter in the particle filter, a process referred to as filter regeneration can be used. Heat regeneration is a commonly used filter regeneration technique which involves increasing the temperature of the accumulated particles until they ignite or combust. The increase of temperature can be caused for example by a fuel burner, or through engine management techniques which cause the exhaust gasses to reach predetermined burning temperatures. The resulting increase in temperature can be felt in the exhaust gasses themselves, and dealing with the heat generated in the exhaust gasses during heat regeneration can thus pose an important design challenge in certain types of vehicles.

There thus remained several needs which remained to be addressed in relation with engine and/or exhaust system heat evacuation and temperature control of exhausting gasses.

SUMMARY

The instant specification teaches an exhaust gas diffuser which can be used to provide an exhaust outlet at the roof of the vehicle, and which can contribute to control the temperature which is reached by the exhaust gasses at a given distance from the vehicle.

In accordance with one aspect, there is provided an exhaust gas diffuser for a vehicle having a passenger area surrounded by walls and covered by a roof, a chamber inside the walls and partitioned from the passenger area, and an exhaust system having an outlet extending upwardly inside the chamber; the diffuser comprising a generally hollow body positioned inside the chamber with an inlet coupled to the outlet of the exhaust system, and a flat outlet grate above the hollow body of the diffuser, oriented parallel to and positioned flush with a surrounding portion of the roof, through which the exhaust gasses are to be released to the atmosphere.

In accordance with another aspect, there is provided an exhaust gas diffuser for a diesel engine vehicle, the diffuser having a hollow body with a lateral diffuser inlet for receiving exhaust gasses from the diesel engine, and an upper diffuser outlet defining a greater cross-sectional area than the inlet, the hollow body forming a closed passage guiding the exhaust gasses from the inlet to the outlet, the hollow body further having a lower recess with a drain, and being generally shaped for liquids received through the diffuser outlet to be channeled to the drain under the effect of gravity.

In accordance with another aspect, there is provided a diesel engine vehicle having a passenger area surrounded by walls and covered by a roof, a chamber inside the walls and partitioned from the passenger area, and a heat-emitting exhaust treatment unit having an outlet extending upwardly inside the chamber, and a diffuser having a hollow body having a proximal end, and a distal end oriented at least partially toward a forward direction of the vehicle relative to the proximal end, a diffuser inlet at the proximal end being connected to an exhaust pipe of the exhaust treatment unit, and a flat outlet grate extending above the hollow body of the diffuser, between the proximal end and the distal end, and oriented parallel to and posisioned flush with a surrounding portion of the roof, the flat outlet grate forming a diffuser outlet leading out from the roof of the vehicle, the flat outlet grate comprising vanes oriented at least partially toward a rear direction of the vehicle.

In accordance with another aspect, there is provided an exhaust gas diffuser comprising: a hollow body shaped generally as a wedge, having a flat outlet with a plurality of slanted vanes, a sloping wall defining a wedge angle with the outlet and connecting the outlet grate at a tip of the hollow body, two opposite lateral walls connecting the sloping wall and the outlet, and an inlet opposite the tip connectable to an exhaust system of a vehicle, the sloping wall and the two opposite lateral walls forming a closed passage between the inlet and the outlet grate.

The instant specification teaches the use of a ventilation conduit, or ventilation shaft, being oriented substantially vertically above the engine compartment and allowing the evacuation of engine heat through an aperture defined in the roof of the vehicle.

The instant specification also teaches positioning components of a vehicle exhaust system, which can include a heat-emitting exhaust treatment unit for example, in a ventilated compartment extending substantially vertically inside the vehicle.

The ventilation conduit can have a ventilation outlet in the roof of the vehicle, at least partly surrounding the exhaust gas outlet of the exhaust system, for example.

DETAILED DESCRIPTION

Figure 1:
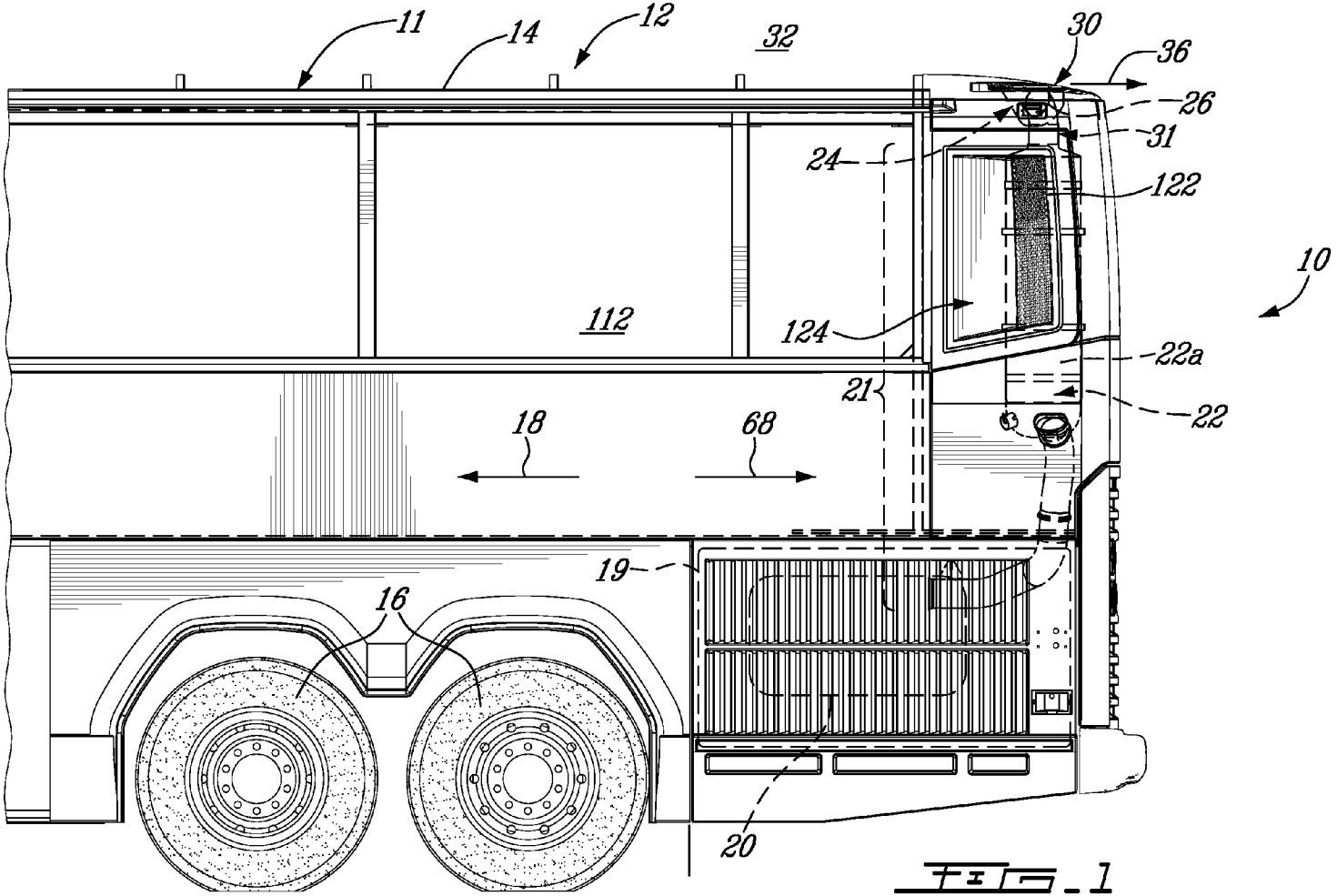
FIG. 1 is a side elevation view of a rear portion of a diesel engine vehicle.
Figure 2:
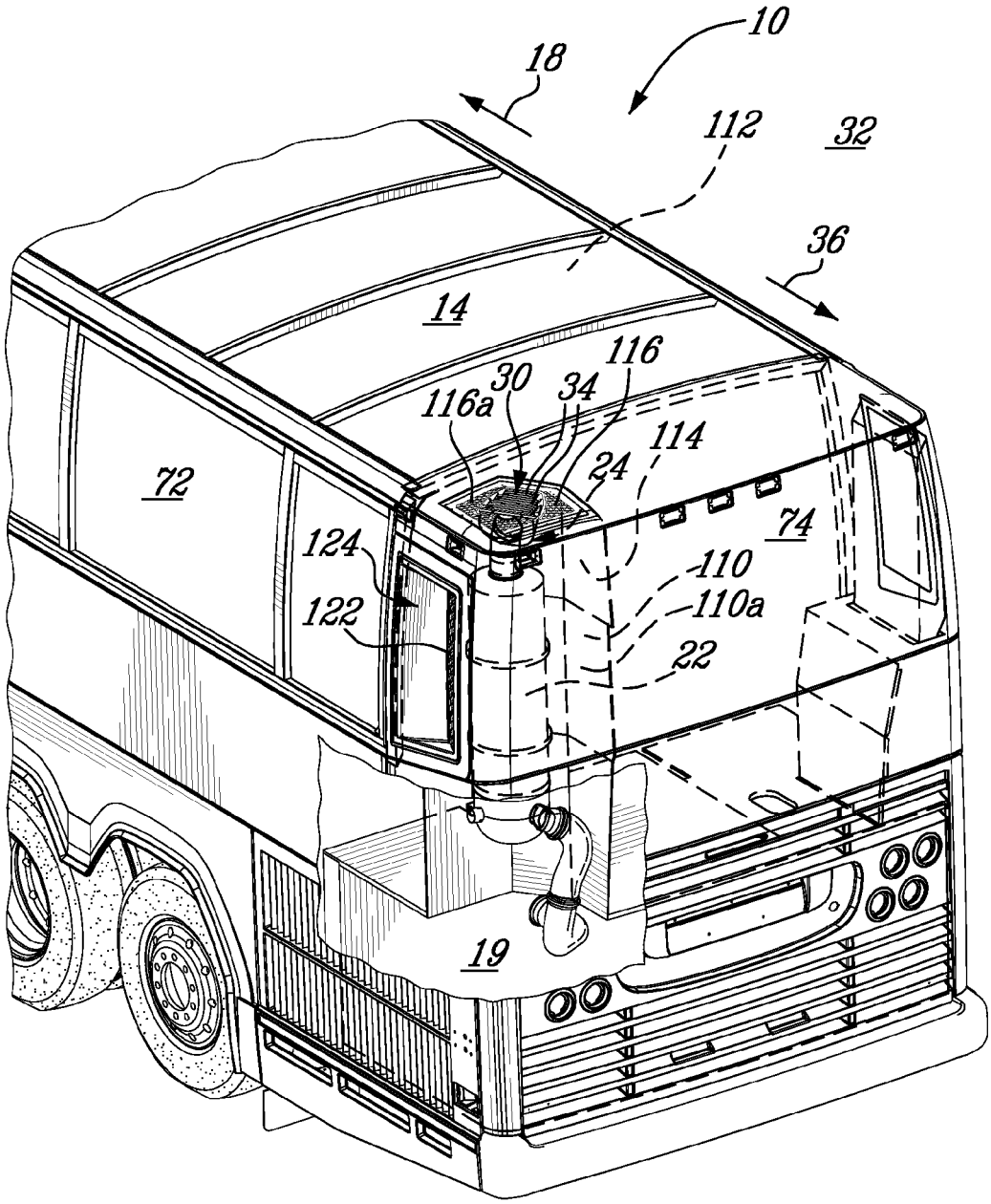
FIG. 2 is left side perspective view of the vehicle of FIG. 1, partly sectioned to show an exhaust system chamber.

FIGS. 1 and 2 show an example of a diesel engine vehicle 10. In this example, the diesel engine vehicle 10 can be adapted for use as a passenger coach or as a motor home, for example. Only the rear portion 12 of the vehicle 10 is illustrated. The vehicle 10 generally has a wheeled body 11 having a roof 14, and wheels 16, and is designed to normally operate in a forward direction 18. The vehicle 10 also has a diesel engine 20 which is housed in an engine compartment 19 in a lower portion of the rear end of the vehicle 10. The diesel engine 20 has an exhaust system 21. The exhaust system 21 includes a exhaust gas treatment unit 22. In this example, the exhaust gas treatment unit 22 is a diesel particle filter 22*a* which is designed for heat-regeneration. The exhaust gas treatment unit 22 receives exhaust gasses from the engine 20, and has an upwardly extending outlet pipe 31.

In this example, a diffuser 24 is connected to the outlet pipe 31 and is used to maintain the temperature of the exhaust gasses below a given threshold at a given distance from the roof 14. The diffuser 24 has a diffuser inlet 26 connected to the exhaust gas treatment unit 22 via the pipe 31, and a diffuser outlet 30 leading to the ambient atmosphere 32 (see also FIG. 2). In this example, the diffuser outlet 30 is substantially flat and aligned with the roof 14 of the vehicle, and is equipped with vanes 34 which guide exhausting gasses in a direction partially aligned with the roof 14, and partially oriented towards the rear 36. In this example, the diffuser outlet 30 arrives flush with the generally horizontal surface of the roof 14. It does not significantly protrude from it, and is thus relatively not visually apparent from the ground.

FIG. 2 shows the exhaust gas treatment unit 22 positioned in a substantially vertically oriented chamber 110 which extends above the engine compartment 19. The chamber 110 can be partitioned from a passenger compartment 112 of the vehicle by a thermally insulated partition 114. The acoustic insulation can also be provided in the partition 114 if desired. The vertically oriented chamber 110 has a ventilation outlet 116 positioned in the roof 14 of the vehicle. In this example, the ventilation outlet 116 has an apertured grate 116*a* which is positioned partially around the vaned diffuser outlet 30. Heat emanated by the exhaust treatment unit 22 can thus be evacuated upwardly along the vertically oriented chamber 110, and through the ventilation outlet 116 to the atmosphere 32 in a chimney-like effect.

Figure 3:
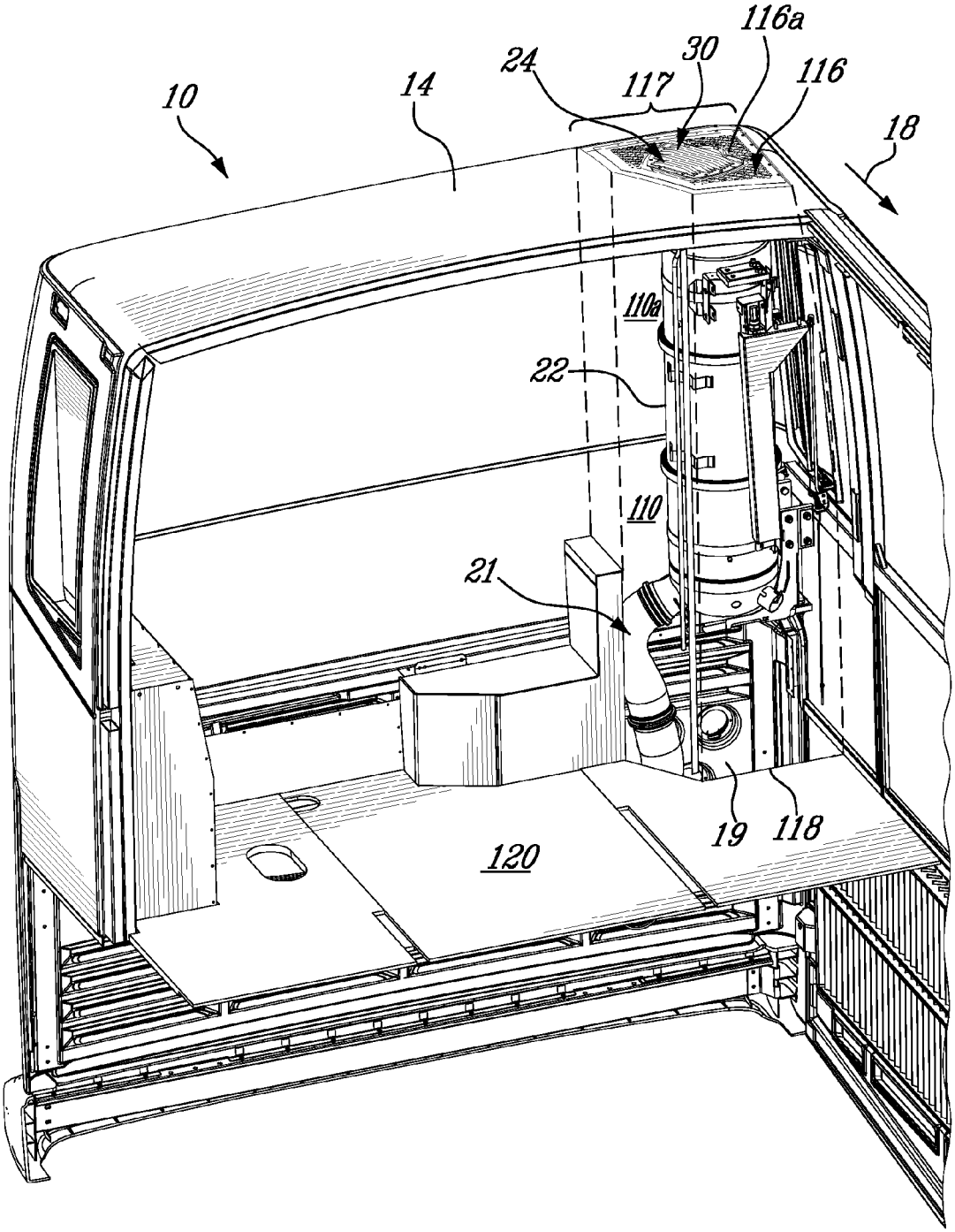
FIG. 3 is an inside perspective view of the of the exhaust system chamber of FIG. 2.

FIG. 3 shows the chamber 110 from the inside, in a fragmented view where the partition (114, FIG. 2) has been made invisible. An opening 118 can be seen in the floor 120, through which the exhaust system 21 extends upwardly. In this example, this opening 118 also connects the chamber 110 to the engine compartment 20, which allows heat from the engine compartment 20 to also be evacuated upwardly in the chimney-like effect. In this example, the chamber 110 can thus be described as a ventilation conduit 110*a*, or cooling duct, which allows heat from the exhaust system 21 and the engine compartment 20 to be evacuated upwardly by natural convection.

One can see that the area 117 of the roof 14 which is allotted to heat evacuation is shared between the diffuser outlet 30, through which exhaust gasses are evacuated, and the ventilation outlet 116, through which hot air from the chamber 110 is evacuated, during use. In applications such as the one illustrated, where the available roof area is limited, there can be a question of optimizing the ratio of the relative areas occupied by both outlets 30, 116. For instance, allotting more area to the diffuser outlet 30 can allow using a larger diffuser 24, which can contribute to reduce the exhaust gas temperatures at a given distance from the diffuser outlet 30, to a certain extent. However, the consequent reduction in the area of the ventilation outlet 116 can have a limiting effect on the heat evacuation from the chamber 110. Therefore, a compromise can have to be made between these two concurrent needs. For illustrative purposes, a ratio of diffuser outlet area to ventilation outlet area of about 1:1 is used in the example detailed above and illustrated, and this ratio allowed to obtain both a satisfactory evacuation of heat from the compartment 110 and satisfactorily low exhaust gas temperatures at a given distances from the diffuser outlet 30. However, other ratios can be used as well, and this question may not be relevant at all in certain alternate applications where the available roof area is not restricted.

Figure 4:
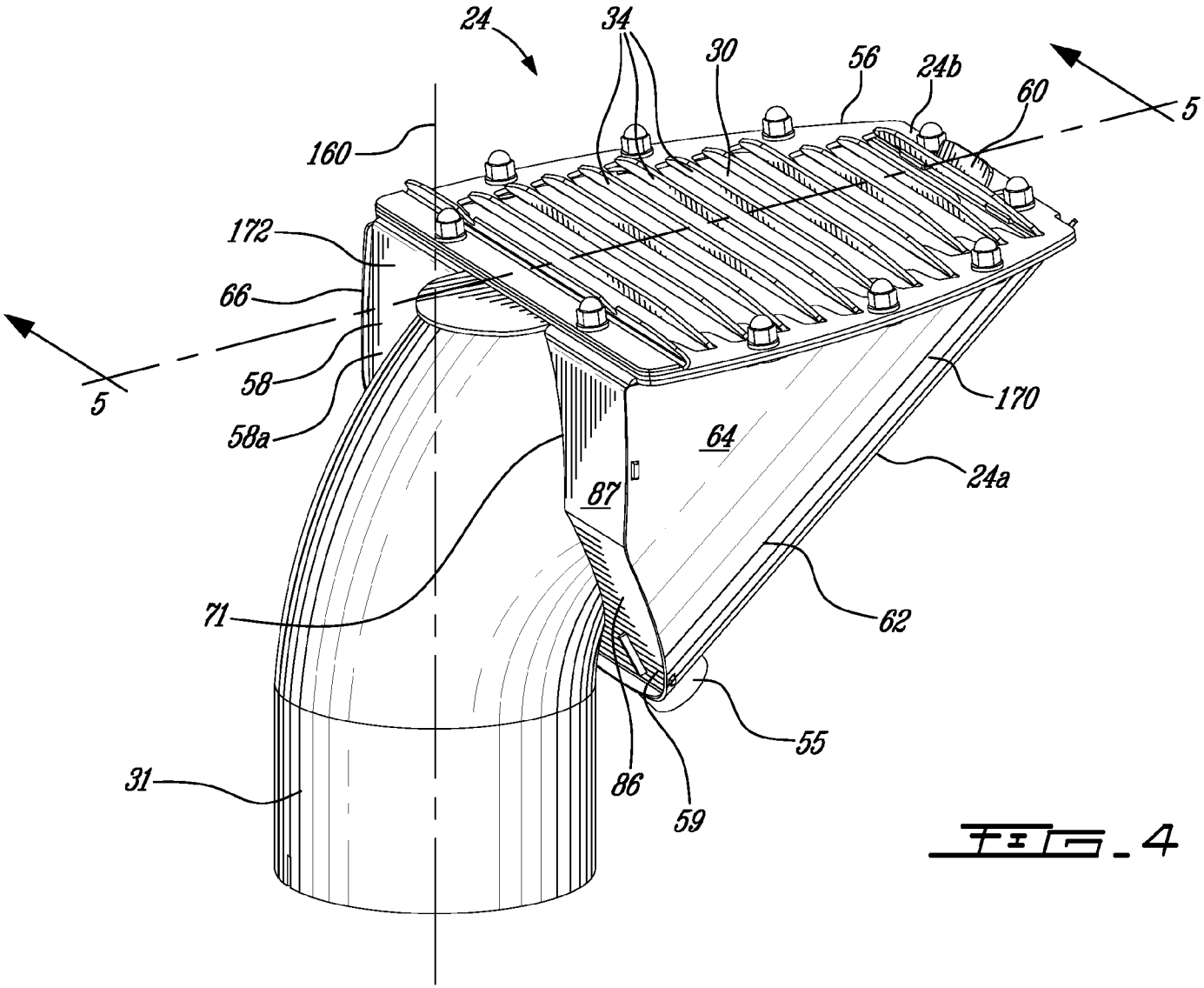
FIG. 4 is a perspective view of a diffuser used in the diesel engine vehicle of FIG. 1.

Turning now to FIG. 4, the diffuser 24 is shown in greater detail. In this example, an inlet pipe 31, for connection of the diffuser 24 to the remainder of the exhaust system 21, is made integral to the diffuser 24. However, in other applications, the inlet pipe 31 can be provided separately from the diffuser 24, for example. In this example, the diffuser 24 is off-centered with respect to the axis 160 of the inlet pipe 31. This can help reducing the likelihood of having water from rain or the like which has penetrated into the diffuser 24 through its outlet 30 from entering the inlet pipe 31. In this example, the diffuser 24 is provided at the end of an elbow which is partially defined by the inlet pipe 31, and is thus extends in a substantially normal direction relative to the axis 160 of the inlet pipe 31.

In this example, the diffuser 24 has a hollow body 24*a* generally provided in the shape of a wedge 24*b*, with a relatively flat grate 56 having a plurality of outwardly slanted vanes 34, an inlet end wall 58 defining a proximal end 58*a* of the diffuser 24 and being connected to the inlet pipe 31 in a manner allowing gas flow communication therewith, a distal end 60, or tip, oriented away from the inlet pipe 31, a transversally curved, and longitudinally sloping bottom wall 62 opposite the grate 56, and side walls 64, 66 extending substantially upwardly from the upwardly curved bottom wall 62 and made integral therewith in this case. The bottom wall 62 and integral side walls 64, 66, form a somewhat truncated conical shape in this case. The angle of the wedge 24*b* is defined between the grate 56 and the sloping bottom wall 62.

The wedge shape of the diffuser 24 can help maintaining a somewhat laminar flow in the exhaust gasses. Experiments with a box-shaped diffuser, for example, have shown that the laminar flow of the exhaust gasses was not conserved as well, which led to an increase in the diffusion of heat through the lateral walls and bottom wall, with the consequence of a greater heat output into the chamber 110 and a higher temperature of the diffuser components.

As shown in FIGS. 2 and 3, in this case, the distal end 60 is oriented partially in a forward direction 18 of the vehicle 10. This configuration provides the advantage of allowing the use of a larger surface or area on the roof 14 of the vehicle 10, while allowing to position the exhaust treatment unit 22 more closely to the corner of the vehicle body 11, between the side wall 72 and the rear wall 74 of the vehicle 10. This can contribute to freeing up passenger space. For illustrative purposes, the horizontal orientation of the distal end 60 of the diffuser 24 in this example is of about 45° from both the side wall 72 and the rear wall 74 of the vehicle 10. This orientation is not critical and can vary in alternate embodiments.

Turning back to FIGS. 4 and 5, the specific construction of this example of a diffuser 24 will now be detailed. The diffuser includes a first sheet metal component 170 which is curved to form the side walls 64, 66 and bottom wall 62. The diffuser also includes a second sheet metal component 172 which includes the inlet wall 58 of the diffuser 24, in which an inlet aperture 71, or inlet, is defined, and which is adapted for attachment to the pipe 31. The inlet wall 58 has a slightly bent lower portion 86. Another portion of the second sheet metal component 172 extends perpendicularly from the upper portion 87 of the inlet wall 58, and covers the upwardly oriented edges of the first sheet metal component 170. In this example, the grate 56 is fastened with the second sheet metal component 172 and can also be fastened with flanges extending from the first sheet metal component 170.

Figure 5:
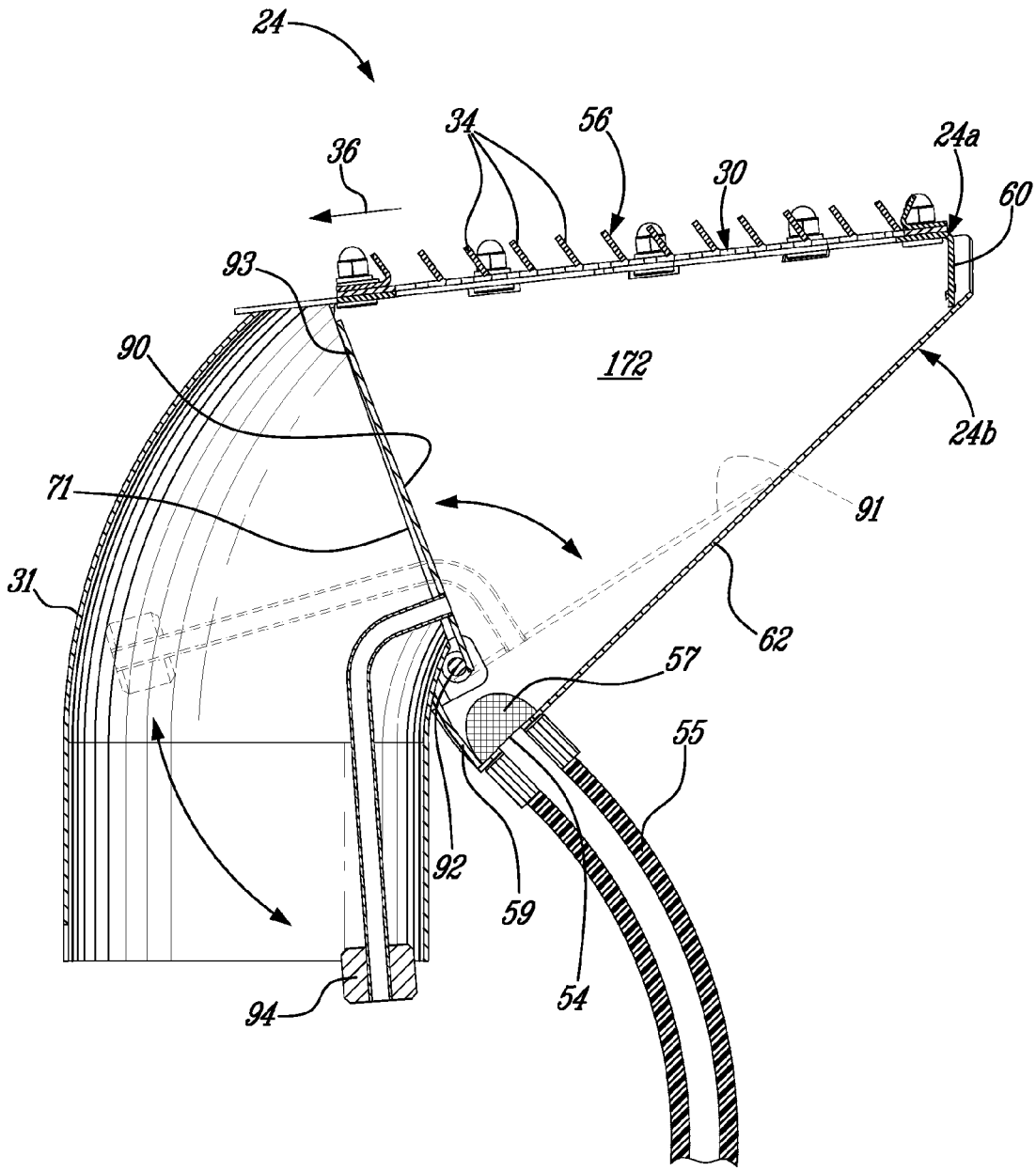
FIG. 5 is an cross-sectional view taken along lines 5-5 in FIG. 4.

In FIG. 5, the internal components of the diffuser 24 are shown. A drain 54 is provided at a lower recess 59 of the diffuser 24, to which water from rain and the like which enters the hollow body 24*a* through the diffuser outlet 30 is channelled to by the curved shape and slanted orientation of the lower wall 62, under the effect of gravity. A drain pipe 55 is connected to the drain 54, on the sloping lower wall 62. A meshed body 57 or screen can be provided on the drain 54, in the hollow body 24*a*, to help prevent debris such as fallen leaves or the like from entering the drain pipe 55.

A closure 90, or flap is pivotally mounted at the inlet 71 of the diffuser 24, and is designed to pivot downwardly towards the bottom wall 62, into an open position 91 when pushed by exhausting gasses, to allow the exhaust gasses to flow relatively freely into the diffuser 24 and out the diffuser outlet 30. In the illustrated configuration, this was achieved by pivotally connecting the closure 90 to the lower portion 86 of the inlet wall 58, proximate the drain 54, with a pivotal connection 92 or hinge. The closure 90 is designed to close automatically onto the diffuser inlet 71 in the absence of a pushing force exerted by the exhausting gasses. In this example, this is achieved by using a counterweight 94 connected to the closure 90 and configured to maintain the center of gravity of the combined closure 90 and counterweight 94 on the inlet pipe side of the pivotal connection 92, horizontally, whether the closure 90 is in a fully closed 93 or fully open 91 position. The pivotal connection 92 is selected to offer relatively low friction, to allow the closure 90 to satisfactorily open under an opening force created by exhausting gasses, and to close under the closing force caused by the action of gravity on the counterweight 94. The counterweight 94 can thus be said to exert a biasing force sufficient to bring back the closure 90 against the inlet 71 in the absence of the opening force of the exhaust gasses. The closure 90, or flap, thus acts as a check valve for the exhaust gasses and contribute to reduce the likelihood or amount of water infiltration into the inlet pipe 31 during events such as rain, or washing the vehicle, when the engine is stopped. In the example described above, the exhaust treatment unit 22 is also provided with a drain to evacuate water which nevertheless enters the inlet pipe 31.

Although any suitable material can be used to make the diffuser 24, sheet metal stainless steel was used in this example. Stainless steel can withstand the temperatures present in the diffuser 24 following heat regeneration of the diesel particle filter, and offers interesting corrosion resistance characteristics.

During use, a main effect of the diffuser 24 is to allow the exhausting gasses to expand prior to their release into the atmosphere, and to guide the exhausting gasses to continue their expansion in the atmosphere. Therefore, the area of the diffuser outlet 30 is made greater than the area of the diffuser inlet 71. The expansion of the exhaust gasses translates into a temperature reduction. The diffuser can thus contribute to maintain the temperature of the exhaust gasses below a predetermined maximum level at a given distance from the roof 14 of the vehicle 10. In this example, the ratio of outlet area to inlet area is of about 3:1. A ratio of up to about 5:1 can be used in alternate embodiments, if sufficient area is available in the body of the vehicle.

In use, the volume occupied by the gasses exiting the regenerator exhaust pipe 28 is increased when they are transferred into the diffuser 24, which has a substantially greater evacuation area than the pipe 31. In the diffuser 24 therefore, the gasses entering the diffuser inlet 71 can undergo a decrease in speed and temperature. In a second step, the gasses exiting the diffuser 24 through the diffuser outlet 30 are allowed to gain even greater volume since they are no longer confined inside walls. This substantial increase in volume which undergo the exhaust gasses leads to a substantial decrease in temperature at a given distance from the diffuser outlet 30, or exhaust port. However, this temperature decrease at the given distance from the diffuser outlet 30 can be further enhanced by using vanes 34 which orient the exhausting gasses at least partially in a transversal direction 36. In this manner, the exhaust gasses are oriented in a direction other than the perpendicular direction from the diffuser outlet 30. This results in a temperature distribution of the exhausting gasses which is oriented at least partially in a direction determined by the vanes 34 and results in a lower temperature when measured at a given perpendicular distance from the diffuser outlet 30.

In this example, the vanes 34 are oriented opposite to the direction at which the exhaust gasses enter the inlet 71. Further, the vanes 34 are slanted toward the rear direction 68 of the vehicle rather than the forward direction 18. For instance, in the above described example, the temperature of the exhausting gasses during following regeneration were of about 500 to 600° C. at 6 inches from the roof 14 when no diffuser 24 was used. With the diffuser 24, the temperature of the exhausting gasses dropped to about 200 to 300° C. at 6 inches from the roof.

For illustrative purposes, the vanes 34 in this case were made with an inclination of about 60° with respect to the outlet top wall 56, in the direction of the proximal side 58*a* of the diffuser 24 (i.e. toward the rear of the coach), as can be seen in FIG. 5. However, it is to be understood that the vanes 34 are optional, and that the inclination angle thereof can greatly depart from the illustrative value of 60° in alternate embodiments. Alternate embodiments can have slanted vanes at an angle between 45° to 70°, or between 40° and 80°, for example. The vanes act as a grate which can help reduce the infiltration of falling leaves or the like, and also have an aerodynamic function. The spacing between the interspaced vanes can have an effect on these two functions. For illustrative purposes, a spacing of about ½ inches was used in the example given above and illustrated. In alternate embodiments, a spacing of between ¼ inches and ¾ inches, or any other suitable spacing or configuration can be used.

If the outlet 30 is provided in a position and orientation where it can receive significant amounts of water due to rain or vehicle washing for example, there is a secondary design consideration to the diffuser 24, which is to allow for the evacuation of the liquids. This is the case when the outlet 30 is positioned on the roof 14, for example. In the illustrated embodiment, the evacuation of liquids is achieved with the drain 54, as the latter is positioned proximate a lowermost point of the diffuser 24, where the liquids are brought under the combined effects of gravity and the channelling action of selected diffuser shape. This second function can be achieved by any suitable design, which can depart from the example given above and illustrated, in alternate embodiments.

The exemplary diffuser construction particulars described above and illustrated are given for means of illustration and comprehension, and are not intended to be interpreted in a limiting manner. It will be understood that various modifications and alternate embodiments can be made.

The diffuser can be used at any suitable location on any suitable vehicle. For example, the diffuser can be used in a bottom portion of a vehicle, with the outlet facing the ground. Alternately, the outlet can face a side of a vehicle, such as through an upper end of a side wall of a vehicle, for example. Alternate embodiments of the diffuser can be specially adapted for such alternate applications.

The drain and closure, or check valve, are optional, and can be omitted in alternate embodiments such as, for example, embodiments in which water is less susceptible of entering into the exhaust system. If a closure is used, it can be biased toward the closed position in any suitable way. A spring can be used to bias the closure toward the closed position in alternate embodiments, for example.

The inlet pipe leading to the diffuser can form an elbow with the diffuser, as depicted in the attached figures, or can be oriented straight into the diffuser, without forming an elbow. If vanes are provided at the outlet of an alternate embodiment of a diffuser, they can be outwardly slanted or inwardly slanted.

An alternate configuration, for example, the diffuser can have a lateral outlet leading out from a side or rear wall of the vehicle, and a lateral inlet opposite the lateral outlet, for receiving the exhaust gasses. The lower recess having the drain can then be located between the lateral inlet and lateral outlet. Such an alternate configuration can have appropriately oriented vanes on the lateral outlet.

In alternate embodiments, the diffuser can be centered around the exhaust system pipe leading to it, or otherwise be less off-centered than in the example given above and illustrated. It will also be understood that shapes other than wedge shapes can alternately be used, and that a more box-like shape, or cylindrical-like shape, for example, can be suitable in certain applications.

Many other variants or alternate applications of the diffuser are also possible.

As can be seen therefore, the embodiments described above and illustrated are intended to be exemplary only. The scope is indicated by the appended claims.

What is claimed is:

1. A diesel engine vehicle having a passenger area surrounded by walls and covered by a roof, a chamber inside the walls and partitioned from the passenger area, and a heat-emitting exhaust treatment unit having an outlet extending upwardly inside the chamber, and a diffuser having a hollow body having a proximal end, and a distal end oriented at least partially toward a forward direction of the vehicle relative to the proximal end, a diffuser inlet at the proximal end being connected to an exhaust pipe of the exhaust treatment unit, and a flat outlet grate extending above the hollow body of the diffuser, between the proximal end and the distal end, and oriented parallel to and positioned flush with a surrounding portion of the roof, the flat outlet grate forming a diffuser outlet leading out from the roof of the vehicle, the flat outlet grate also comprising vanes oriented at least partially toward a rear direction of the vehicle; further comprising a closure pivotally mounted within the hollow body, the closure being pivotally biased towards a closed position, against the inlet, the closure being pivotable into an open position, against the bias, by a force exerted by exhausting gasses.

2. A diesel engine vehicle having a passenger area surrounded by walls and covered by a roof, a chamber inside the walls and partitioned from the passenger area, and a heat-emitting exhaust treatment unit having an outlet extending upwardly inside the chamber, and a diffuser having a hollow body having a proximal end, and a distal end oriented at least partially toward a forward direction of the vehicle relative to the proximal end, a diffuser inlet at the proximal end being connected to an exhaust pipe of the exhaust treatment unit, and a flat outlet grate extending above the hollow body of the diffuser, between the proximal end and the distal end, and oriented parallel to and positioned flush with a surrounding portion of the roof, the flat outlet grate forming a diffuser outlet leading out from the roof of the vehicle, the flat outlet grate also comprising vanes oriented at least partially toward a rear direction of the vehicle; wherein the hollow body has a lower recess having a drain, and is shaped for channeling liquids toward the drain under the effect of gravity.

3. A diesel engine vehicle having a passenger area surrounded by walls and covered by a roof, a chamber inside the walls and partitioned from the passenger area, and a heat-emitting exhaust treatment unit having an outlet extending upwardly inside the chamber, and a diffuser having a hollow body having a proximal end, and a distal end oriented at least partially toward a forward direction of the vehicle relative to the proximal end, a diffuser inlet at the proximal end being connected to an exhaust pipe of the exhaust treatment unit, and a flat outlet grate extending above the hollow body of the diffuser, between the proximal end and the distal end, and oriented parallel to and positioned flush with a surrounding portion of the roof, the flat outlet grate forming a diffuser outlet leading out from the roof of the vehicle, the flat outlet grate also comprising vanes oriented at least partially toward a rear direction of the vehicle; wherein the hollow body is wedge-shaped, and the inlet is provided opposite a tip of the wedge shape.

4. An exhaust gas diffuser comprising: a hollow body shaped generally as a wedge, having a flat outlet with a plurality of slanted vanes, a sloping wall defining a wedge angle with the outlet and connecting the outlet grate at a tip of the hollow body, two opposite lateral walls connecting the sloping wall and the outlet, and an inlet opposite the tip connectable to an exhaust system of a vehicle, the sloping wall and the two opposite lateral walls forming a closed passage between the inlet and the outlet grate.

5. The exhaust gas diffuser of claim 4 wherein the vanes are oriented to guide exhausting gasses in a direction at least partially opposite to the general direction at which the exhausting gasses enter the diffuser through the inlet.

6. The exhaust gas diffuser of claim 4 further comprising an inlet pipe connected to the inlet and defining an elbow with the hollow body.

7. The exhaust gas diffuser of claim 4 wherein the outlet has an area having a ratio of above 3:1 with an area of the inlet.

8. The exhaust gas diffuser of claim 4 wherein the vanes are provided as part of an outlet grate and are inclined between 40° and 80° relative to the outlet grate, and interspaced between ¼ and ¾ inches apart.

9. The exhaust gas diffuser of claim 4 further comprising a closure pivotally mounted within the hollow body, the closure being pivotlally biased into a closed position, against the inlet, the closure being pivotable from the closed position into an open position, against the bias, by a force exerted by exhausting gasses; and a drain positioned at an end of the sloping wall, opposite the tip.

10. The exhaust gas diffuser of claim 4 having a check valve allowing gasses through the diffuser inlet and out the diffuser outlet when the engine is running, but substantially preventing liquids in the hollow body from entering the exhaust pipe outlet when the engine is stopped:

11. The exhaust gas diffuser of claim 10 wherein the check valve has a pivotable flap which opens in a downward direction inside the hollow body under a force applied by the exhausting gasses, and a counterweight that automatically closes the flap back against the exhaust pipe outlet when the engine is stopped.

12. The exhaust gas diffuser of claim 4 wherein the hollow body is shaped for the exhaust gasses to travel roughly parallel to the grate before being released into the atmosphere through the grate.

13. A diesel engine vehicle having a passenger area surrounded by walls and covered by a roof, a chamber inside the walls and partitioned from the passenger area, and a heat-emitting exhaust treatment unit having an outlet extending upwardly inside the chamber, and a diffuser having a hollow body having a proximal end, and a distal end oriented at least partially toward a forward direction of the vehicle relative to the proximal end, a diffuser inlet at the proximal end being connected to an exhaust pipe of the exhaust treatment unit, and a flat outlet grate extending above the hollow body of the diffuser, between the proximal end and the distal end, and oriented parallel to and positioned flush with a surrounding portion of the roof, the flat outlet grate forming a diffuser outlet leading out from the roof of the vehicle, the flat outlet grate also comprising vanes oriented at least partially toward a rear direction of the vehicle; wherein the hollow body forms a closed passage guiding the exhaust gasses from the inlet to the outlet; wherein the hollow body is substantially wedge-shaped, and the inlet is provided opposite a tip of the wedge shape further comprising a closure pivotally mounted within the hollow body, the closure being pivotally biased into a closed position, against the inlet, the closure being pivotable from the closed position into an open position, against the bias, by a force exerted by exhausting gasses; wherein the grate includes a plurality of interspaced vanes for orienting the exhaust gasses at least partially toward the rear of the vehicle; and wherein the hollow body has a lower recess having a drain, and is generally shaped for channeling liquids in the hollow body toward the drain under the effect of gravity.

14. The exhaust gas diffuser of claim 13 wherein the vanes are interspaced, the tip of the wedge shape is oriented at least partially toward a front direction of the vehicle, and the vanes are inclined upwardly between 40° and 80° relative to the grate, in a direction opposite to the tip of the wedge shape, and interspaced between ¼ and ¾ inches apart.

* * * * *